US007223213B2

(12) United States Patent
Golesh

(10) Patent No.: US 7,223,213 B2
(45) Date of Patent: May 29, 2007

(54) DUAL-DIRECTION PULLEY SYSTEM

(75) Inventor: Eric D. Golesh, Thornton, CO (US)

(73) Assignee: Nautilus, Inc., Vancouver, WA (US)

( * ) Notice: Subject to any disclaimer, the term of this patent is extended or adjusted under 35 U.S.C. 154(b) by 665 days.

(21) Appl. No.: 10/635,072

(22) Filed: Aug. 6, 2003

(65) Prior Publication Data

US 2004/0082444 A1 Apr. 29, 2004

Related U.S. Application Data

(60) Provisional application No. 60/402,327, filed on Aug. 8, 2002.

(51) Int. Cl.
*A63B 23/04* (2006.01)
*A63B 21/062* (2006.01)

(52) U.S. Cl. ..... 482/100; 482/137; 482/138; 482/145

(58) Field of Classification Search ..... 482/92, 482/93, 98–100, 133–138, 145
See application file for complete search history.

(56) References Cited

U.S. PATENT DOCUMENTS

| | | | | |
|---|---|---|---|---|
| 457,400 | A | 8/1891 | Dowd | |
| 551,803 | A | 12/1895 | Whitely | |
| 595,492 | A | 12/1897 | McFadden | |
| 664,210 | A | 12/1900 | Bryon, Jr. | |
| 685,788 | A | 11/1901 | McFadden | |
| 2,131,570 | A | 9/1938 | Riley | |
| 3,712,613 | A | 1/1973 | Feather et al. | |
| 3,912,261 | A | 10/1975 | Lambert, Sr. | |
| 3,970,302 | A | 7/1976 | McFee | |
| 4,200,279 | A | 4/1980 | Lambert, Jr. | |
| 4,208,049 | A | 6/1980 | Wilson | |
| 4,231,568 | A | 11/1980 | Riley et al. | |
| 4,296,924 | A | 10/1981 | Anzaldua et al. | |
| 4,333,644 | A | 6/1982 | Lambert, Jr. et al. | |
| 4,349,191 | A * | 9/1982 | Lambert et al. | 482/100 |
| 4,349,193 | A * | 9/1982 | Lambert et al. | 482/100 |
| 4,448,412 | A * | 5/1984 | Brentham | 482/112 |
| 4,456,245 | A | 6/1984 | Baldwin | |

(Continued)

FOREIGN PATENT DOCUMENTS

| | | |
|---|---|---|
| CH | 457230 | 5/1968 |

(Continued)

OTHER PUBLICATIONS

"Odyssey 5" Home Gym, Tuff Stuff, cover page of product brochure and three images therefrom, 2 pages, (2001).

(Continued)

*Primary Examiner*—(Jackie) Tan-Uyen Ho
*Assistant Examiner*—Victor K. Hwang
(74) *Attorney, Agent, or Firm*—Dorsey & Whitney LLP

(57) ABSTRACT

A dual-direction pulley system is disclosed in conjunction with an exercise machine. The pulley system provides resistance to a pivotally mounted actuator lever when the lever is rotated clockwise and when the lever is rotated counterclockwise. In a preferred embodiment the dual-direction pulley system provides resistance for a seated leg curl/extension exercise machine such that a user can perform leg curls and leg extensions from a single seated position.

19 Claims, 10 Drawing Sheets

U.S. PATENT DOCUMENTS 4,468,025 A 8/1984 Sferle
4,478,411 A 10/1984 Baldwin
4,493,485 A 1/1985 Jones
4,502,681 A 3/1985 Blomqvist
4,505,475 A 3/1985 Olschansky et al.
4,511,137 A 4/1985 Jones
4,512,571 A 4/1985 Hermelin
4,537,396 A 8/1985 Hooper
4,540,171 A 9/1985 Clark et al.
4,603,855 A 8/1986 Sebelle
4,621,807 A * 11/1986 Stramer ..... 482/100
4,624,457 A 11/1986 Silberman et al.
4,627,614 A * 12/1986 de Angeli ..... 482/97
4,634,127 A 1/1987 Rockwell
4,648,594 A 3/1987 Schleffendorf
4,685,670 A 8/1987 Zinkin
4,697,809 A 10/1987 Rockwell
4,709,920 A 12/1987 Schnell
4,711,448 A * 12/1987 Minkow et al. ..... 482/100
4,733,860 A 3/1988 Steffee
4,763,897 A 8/1988 Yakata
4,793,608 A 12/1988 Mahnke et al.
4,799,671 A 1/1989 Hoggan et al.
4,826,157 A 5/1989 Fitzpatrick
4,836,536 A 6/1989 Jones
4,842,268 A 6/1989 Jenkins
4,844,456 A 7/1989 Habing et al.
4,848,741 A 7/1989 Hermanson
4,863,163 A 9/1989 Wehrell
4,898,381 A 2/1990 Gordon
4,900,018 A 2/1990 Ish, III et al.
4,902,009 A 2/1990 Jones
4,907,798 A 3/1990 Burchatz
4,911,438 A 3/1990 Van Straaten
4,930,768 A 6/1990 Lapcevic
4,974,838 A 12/1990 Sollenberger
4,982,955 A 1/1991 Heasley
4,986,538 A 1/1991 Ish, III
5,013,031 A 5/1991 Bull
5,037,089 A 8/1991 Spagnuolo et al.
5,039,089 A 8/1991 Lapcevic
5,039,091 A 8/1991 Johnson
5,074,551 A * 12/1991 Olschansky et al. ..... 482/137
5,076,576 A 12/1991 Johnston
5,080,351 A 1/1992 Rockwell
5,090,694 A 2/1992 Pauls et al.
D324,710 S 3/1992 Habing
5,102,121 A 4/1992 Solow
5,147,265 A 9/1992 Pauls et al.
5,195,937 A 3/1993 Engel et al.
5,221,245 A 6/1993 Yeh
5,236,406 A 8/1993 Webber
5,244,446 A 9/1993 Engel et al.
5,263,914 A 11/1993 Simonson et al.
5,263,915 A 11/1993 Habing
5,267,930 A 12/1993 Henes
RE34,572 E 3/1994 Johnson et al.
5,302,161 A 4/1994 Loubert et al.
5,308,304 A 5/1994 Habing
5,316,534 A 5/1994 Dalebout et al.
5,330,405 A 7/1994 Habing et al.
5,354,248 A 10/1994 Rawls et al.
5,354,252 A 10/1994 Habing
5,356,360 A 10/1994 Johns
5,366,426 A 11/1994 Glavin
5,382,212 A 1/1995 Davenport et al.
5,395,295 A 3/1995 Ish, III
5,409,435 A 4/1995 Daniels
D358,183 S 5/1995 Habing et al.
5,413,546 A 5/1995 Basile
5,433,680 A 7/1995 Knudsen
5,437,589 A 8/1995 Habing
5,468,202 A 11/1995 Habing
5,470,299 A 11/1995 Yeh
5,518,477 A 5/1996 Simonson
5,527,245 A 6/1996 Dalebout
5,549,530 A 8/1996 Fulks
5,549,533 A 8/1996 Olson et al.
5,554,085 A 9/1996 Dalebout
5,565,002 A 10/1996 Rawls et al.
5,586,962 A 12/1996 Hallmark
5,624,353 A 4/1997 Naidus
5,667,465 A * 9/1997 McCollum et al. ..... 482/100
5,722,921 A 3/1998 Simonson
5,733,229 A 3/1998 Dalebout et al.
5,733,233 A 3/1998 Webber ..... 482/137
5,755,645 A 5/1998 Miller et al.
5,807,219 A 9/1998 Webber et al.
5,820,529 A 10/1998 Weintraub
5,860,894 A 1/1999 Dalebout
5,885,193 A * 3/1999 Habing et al. ..... 482/92
5,944,641 A 8/1999 Habing
5,961,427 A 10/1999 Habing et al.
5,961,428 A 10/1999 Webber
5,980,434 A * 11/1999 Webber ..... 482/100
5,989,165 A 11/1999 Giannelli et al.
6,027,429 A 2/2000 Daniels
6,059,701 A 5/2000 George et al.
6,090,020 A * 7/2000 Webber ..... 482/100
6,165,109 A * 12/2000 Plamann ..... 482/97
6,203,475 B1 * 3/2001 Plamann ..... 482/100
D439,941 S 4/2001 Batca et al.
6,238,323 B1 5/2001 Simonson
6,296,594 B1 10/2001 Simonson
6,319,178 B1 11/2001 Webber
6,361,482 B1 * 3/2002 Batca et al. ..... 482/100
6,387,020 B1 5/2002 Simonson
6,443,877 B1 9/2002 Hoecht et al.
6,447,430 B1 9/2002 Webb et al.
6,488,612 B2 12/2002 Sechrest et al.
6,491,610 B1 12/2002 Henn
6,527,683 B2 3/2003 Tolles
6,558,303 B1 * 5/2003 Ellis ..... 482/138
6,579,213 B1 6/2003 Webber et al.
6,592,498 B1 7/2003 Trainor
6,595,905 B2 7/2003 McBride
6,666,801 B1 * 12/2003 Michalow ..... 482/137
6,676,574 B1 1/2004 Prokop et al.
6,685,607 B1 2/2004 Olson
6,689,019 B2 2/2004 Ohrt et al.
6,689,023 B2 2/2004 Baumler
6,743,158 B2 6/2004 Giannelli et al.
6,770,015 B2 8/2004 Simonson
7,004,890 B2 2/2006 Webb et al.
7,083,554 B1 8/2006 Lo Presti
2003/0017918 A1 1/2003 Webb et al.
2003/0027696 A1 2/2003 Baumler et al.
2003/0032531 A1 2/2003 Simonson
2003/0045406 A1 3/2003 Stone
2003/0078141 A1 4/2003 Webber
2003/0092540 A1 5/2003 Gillen
2003/0092541 A1 5/2003 Giannelli
2003/0096681 A1 5/2003 Myers et al.
2003/0100413 A1 5/2003 Huang
2003/0176261 A1 9/2003 Simonson et al.
2004/0002409 A1 * 1/2004 Webb et al. ..... 482/98
2004/0005966 A1 1/2004 Chen
2004/0009856 A1 1/2004 Hammer
2005/0124470 A1 6/2005 Schopf

FOREIGN PATENT DOCUMENTS

DE 3843404 A * 6/1990
DE 198 01 672 A1 11/1998

| | | | |
|---|---|---|---|
| GB | 2 232 089 | A | 12/1990 |
| SU | 1253654 | | 8/1986 |
| SU | 1 720 666 | A1 | 3/1992 |
| SU | 1743620 | | 6/1992 |
| TW | 210014 | | 7/1993 |
| TW | 317755 | | 10/1997 |
| TW | 364363 | | 7/1999 |

OTHER PUBLICATIONS

"8300s Series II Strength System", Schwinn Cycling & Fitness Inc., one page of product brochure showing 8300 Series II Strength System, 1 page, (1999).

"Nautilus Time Machine", Nautilus, Inc., cover page of product brochure and one page therefrom, 2 pages, (date unknown).

"V5 Multi Gym", Hoist Fitness Systems, Inc., located at http://www.hoistfitness.com, 3 pages, (2003/2004, website pages printed on Feb. 24, 2004 and Apr. 30, 2004).

"HD 1800 Inner/Outer Thigh", Hoist Fitness Systems, Inc., located at http://www.hoistfitness.com, 3 pages, (2003/2004, website pages printed on Feb. 24, 2004 and Apr. 30, 2004).

"Cross Bow by Weider," manual, ICON Health & Fitness, Inc., 22 pages (undated).

"Cross Bow by Weider How Does the Crossbow Stack up Against the Competition", ICON Health and Fitness located at http://www.iconfitness.com/crossbow/cb_vs_bf.html, 2 pages (retrieved Oct. 22, 2002).

Cybex World, "New Products Prove Passion for Human Performance," vol. 10, Issue 2 (Jul. 2000).

Nautilus® Home Gyms 2001 brochure, 12 pages (2001).

PowerLine by TuffStuff, Task Industries Inc., PL-221, Leg Curl/Extension Combo, undated brochure.

Schwinn® Fitness, "Harness the Force of Nature and You Possess the Strength of Confidence" brochure 32 pages (1996-1997).

"Stamina LT-2000 Band Flex Gym", Stamina Products, Inc., located at Egghead.com, 3 pages (at least as early as Mar. 9, 2001).

"Club Series Beyond Life Fitness Strength", LifeFitness, 16 pages (date unknown).

* cited by examiner

DUAL-DIRECTION PULLEY SYSTEM

This application claims the benefit of related U.S. Provisional Application Ser. No. 60/402,327, filed on Aug. 8, 2002. U.S. Provisional Application Ser. No. 60/402,327 is hereby incorporated by reference.

FIELD OF INVENTION

This invention relates to pulley systems allowing resisted motion in two directions, for example in weight stack applications. More particularly, this invention is a dual-direction pulley system for use in a seated leg curl/leg extension station on a multi-station weight stack.

BACKGROUND

Leg extension and leg curl exercises typically have to be performed on separate machines due to the opposite motions required for each exercise. In a leg extension, the user extends his leg from a 90 degree position to a straight position. This exercise uses the muscles in the top, front (quadriceps) of the leg. In a leg curl, the user contracts his leg from a straight position to a 90 degree position. This exercise uses the muscles in the top, back (hamstring) of the leg. These two directions are opposite one another, and hence a leg curl and a leg extension have historically been performed on different pieces of equipment.

A combined leg extension/curl bench has been developed, which has only one direction of loaded cable extension. This means that the direction of tensioning the cable is in one direction only, requiring that the user sit and extend his leg (as described above), using one set of actuating pads with the front of his ankles/shins. To perform a leg curl, the user must reorient himself on the machine and lie down on his stomach and engage a second set of actuating pads with the rear of his ankles/calves. Again, this development loaded the cable system only when the cable was tensioned in one direction, thus requiring the user to change positions on the machine. Lying down also takes up quite a bit of space compared to sitting, and thus these benches are quite large.

A separate standing leg curl has been developed where the user exercises one leg at a time from a standing position.

What is needed in the art is a seated leg extension/curl station that allows loading of the cable in such a manner as to create resistance in opposite directions so a user can perform a seated leg curl and a seated leg extension without substantially changing the user's general position.

SUMMARY OF THE INVENTION

The invention is directed to a dual-direction pulley system for resisting motion in two directions. One embodiment of the pulley system includes a first main pulley having an actuator attached thereto, and second and third main pulleys. A first cable is fixed to and wrapped at least part of the way around the first main pulley and is fixed to and wrapped at least part of the way around the second main pulley. A second cable is fixed to and wrapped at least part of the way around the first main pulley opposite from the first cable and is fixed to and wrapped at least part of the way around the third main pulley. A tensioner cable has one end wrapped at least partially around the second main pulley opposite of the first cable and has the opposite end wrapped at least partially around the third main pulley opposite of the second cable. A pulley arm is reactive to movement of either of the second or third main pulleys. The pulley arm is attached to a load mechanism, and movement of the actuator causes movement of the pulley arm to engage the load mechanism. A tensioner pulley may also be provided around which the tensioner cable is wrapped at least part way.

In another embodiment the dual-direction pulley system the actuator is angularly adjustable with respect to the first main pulley to permit multiple rest positions for the actuator. The angular adjustment of the actuator may be accomplished by a retractable pin that passes through an opening in the actuator and engages one of a plurality of openings in the perimeter of the first main pulley. A first catch may be provided on the second main pulley to engage the pulley arm upon movement of the actuator in a first direction. A second catch may be provided on the third main pulley to engage the pulley arm upon movement of the actuator in a second direction opposite to the first direction. The pulley arm may be pivotal about a common axis with the second and third main pulleys. A frame may be provided with at least one hollow member for mounting the first, second and third main pulleys such that the first and second cables are at least partially contained within the hollow frame member. In a further preferred embodiment a seat is provided such that a user can perform seated leg extensions by moving the actuator in a first direction and seated leg curls by moving the actuator in a second direction opposite to the first direction. The actuator may be a lever that includes a first pad and a second pad, wherein the second pad is eccentrically rotatably mounted to the lever in order to hold the leg of a user in place between the first and second pad during a leg curl exercise, and to accommodate legs of different sizes.

In a preferred embodiment an exercise apparatus is disclosed that provides resistance to movement in opposite directions. The exercise apparatus includes a frame, with an actuating lever pivotally mounted thereon. The actuating lever is suitable for engagement by a body-part of a user. The actuating lever will pivot in both a clockwise and a counterclockwise direction. A pulley system is connected between a load mechanism and the actuating lever to provide resistance to the rotation of the actuating lever in both the clockwise direction and the counterclockwise direction. The pulley system may include first, second, and third main pulleys. The first main pulley is connected to the second main pulley by a first cable. The first main pulley is connected to the third main pulley by a second cable. The second and third main pulleys are connected by a tensioning cable. The interconnection of cables achieves the result that rotation of the first main pulley causes corresponding rotation of the second and third main pulleys without slack being created in the cables. The actuating lever is preferably attached to the first main pulley such that rotation of the actuating lever initiates rotation of the first main pulley. The exercise apparatus may further include a pulley arm connected to a load. The second and third main pulleys are equipped with catches. The catch on the second main pulley engages the pulley arm when the first main pulley is rotated in a clockwise direction to provide resistance to movement of the first main pulley in the clockwise direction. The catch on the third main pulley engages the pulley arm when the first main pulley is rotated in a counterclockwise direction to provide resistance to movement of the first main pulley in the counterclockwise direction.

Accordingly, it is a primary object of the present invention to provide a dual-direction pulley system that provides resistance to movement of an actuator in a first direction and provides resistance to movement of the actuator in a second direction opposite to the first direction.

Other aspects, features and details of the present invention can be more completely understood by reference to the following detailed description in conjunction with the drawings, and from the appended claims.

DETAILED DESCRIPTION OF PREFERRED EMBODIMENTS

The present inventive dual-direction pulley system is embodied in a seated leg curl/extension exercise machine, either independent from or designed as a portion of a multi-station weight machine. One such multi-station weight machine is the NS-700 by Nautilus, Inc. It is contemplated that this dual-direction pulley system can be embodied in other types of exercise equipment for the same or different exercises, or in load-transfer structures where dual-direction load transfers are required.

Figure 1A:
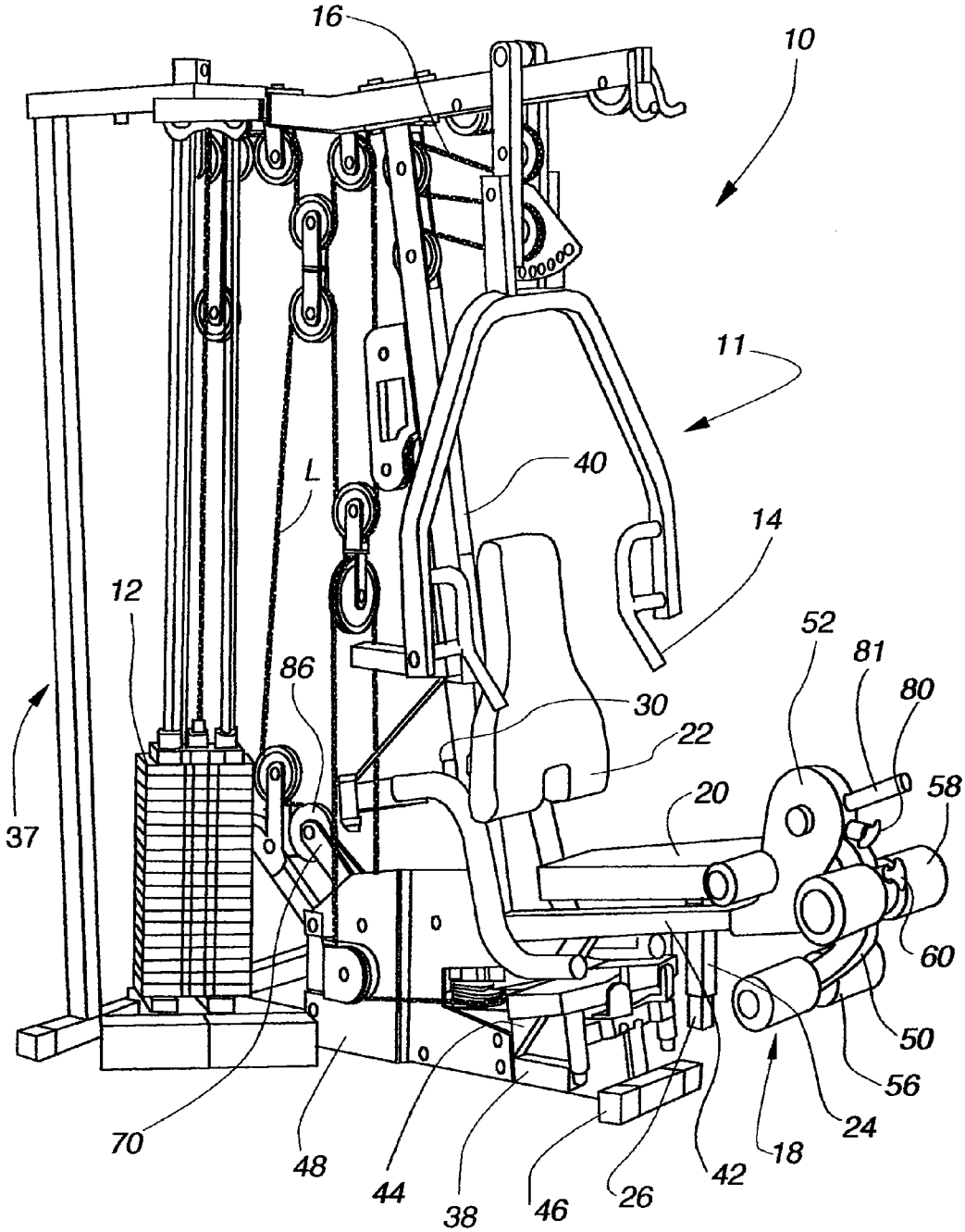
FIG. 1A is a perspective view of an exercise machine including a seated leg curl/extension machine utilizing the unique pulley system of the present invention.
Figure 3:
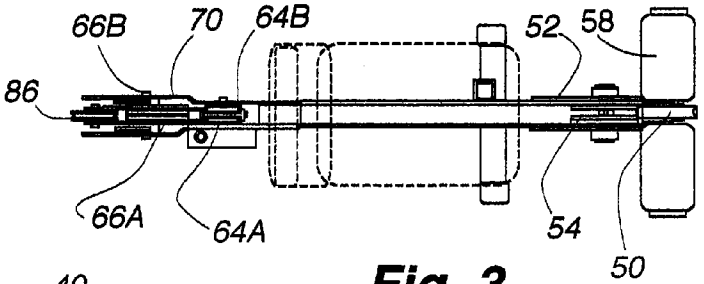
FIG. 3 is a partial top plan view of the frame and mast assembly of the pulley system of the present invention.

FIG. 1A shows a multi-station weight machine 10 that incorporates the dual-direction pulley system 5 of the present invention. The weight machine 10 includes a weight stack 12 for providing resistance to various movements for exercises performed at the weight machine stations. In the embodiment shown in FIG. 1A, the weight machine 10 includes a chest exercise station 11 with handles 14 for performing chest and arm exercises. Load cables 16 transmit the resistance of the weight stack 12 to the chest exercise station 11 to resist movement of the handles 14. Additional stations could be added to the weight machine 10. The chest exercise station 11 shown in FIG. 1A does not utilize the dual-direction pulley system, and will not be described in detail.

A leg station 18 for performing seated leg curls and leg extensions is also incorporated into the weight machine 10. The leg station 18 incorporates the dual-direction pulley system 5 of the present invention. The exercise machine 10 is provided with a seat 20 and backrest 22. Preferably the seat 20 and backrest 22 are padded for comfort. The seat 20 has a seat support bar 26 that is adjustable upward and downward within in seat support tube 24. A seat pop-pin 28 engages one of a plurality of corresponding holes in the seat support bar 26 to hold the seat 20 in place. Similarly, the backrest supported by backrest support tube 30, which engages backrest bar 32. Backrest pop-pin 34 engages one of a plurality of corresponding holes in the backrest bar 32 to adjust the backrest forward and rearward.

Figure 4:
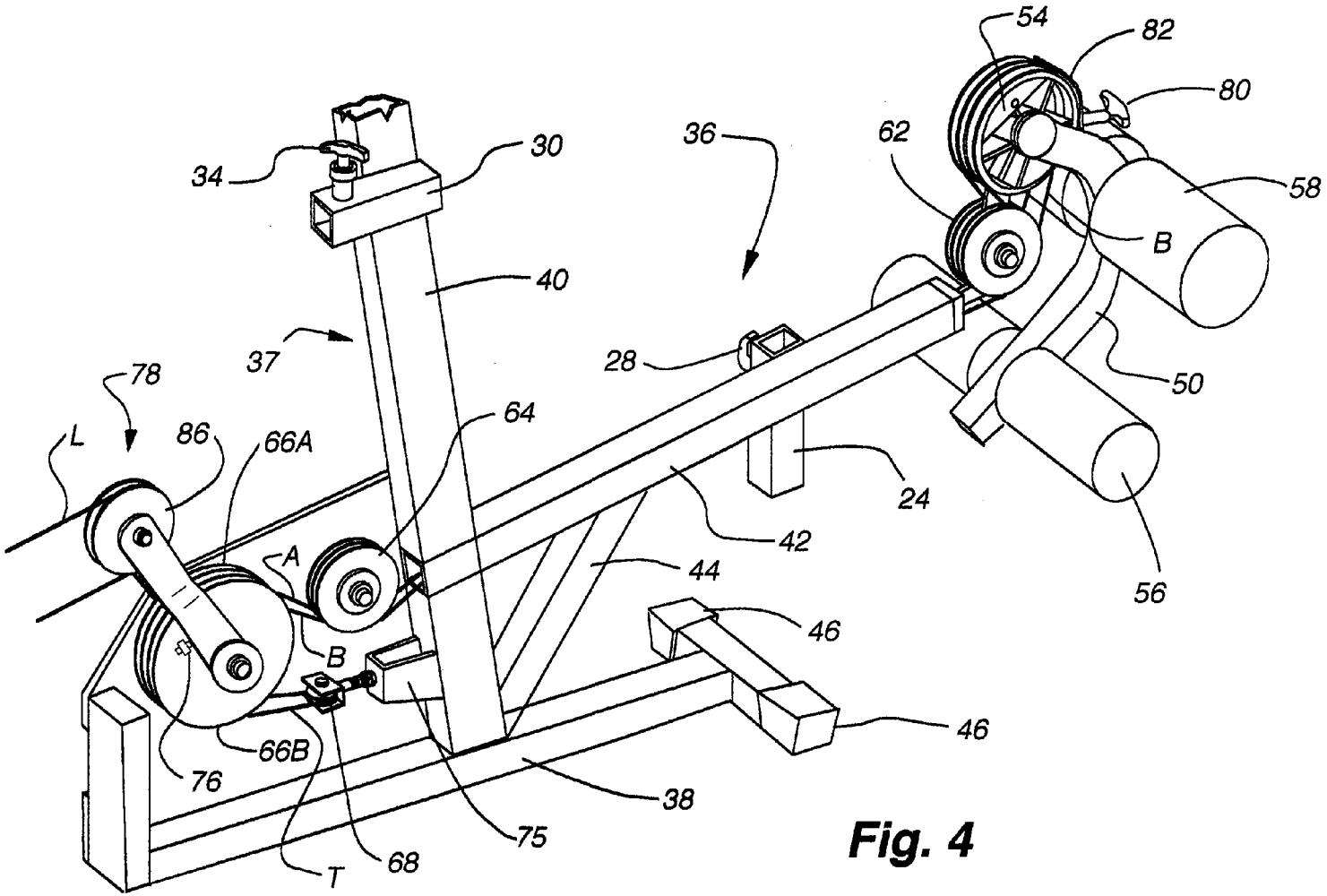
FIG. 4 is a partial perspective view of the frame and mast assembly of the pulley system of the present invention.

As best seen in FIG. 4, a frame assembly 37 is the skeleton structure supporting the pulley system 5, seat support tube 24, and backrest support tube 30. The frame structure includes a base 38 resting on a floor or support surface. A mast 40 is attached to the base 38 and extends upwardly therefrom. A seat frame 36 extends from the mast 40 at a point above the base 38, and in the same direction as one side of the base 38. This indicates the front end of the pulley system. Preferably, a cross-member (not shown) extends laterally outwardly from the seat frame 36 to support the seat 20. The seat frame 36 also includes an elongated main seat frame member 42. Preferably the frame 37, and especially the main seat frame member 42, is formed from rigid hollow tubes. A brace 44 helps support the main seat frame member 42. Feet 46 provide lateral support for the seat frame 36.

The mast 40 supports the seat frame 36, backrest 22 and part of the pulley system. It also facilitates positioning pulleys above the user for use while seated, such as lat pull-downs and the like. These upper pulleys are not part of the instant inventive pulley system as described herein in the preferred embodiment. The arm handles and the bench-press handles do not form part of the instant inventive pulley system as described herein in the preferred embodiment.

A rear housing 48 (see FIGS. 6–10) is formed around the base 38 from the mast 40 rearwardly to the rear end of the base 38, and from the base 38 up to just above the seat frame 36. Only one side of this housing is shown in FIGS. 7–10 for clarity.

Figure 1B:
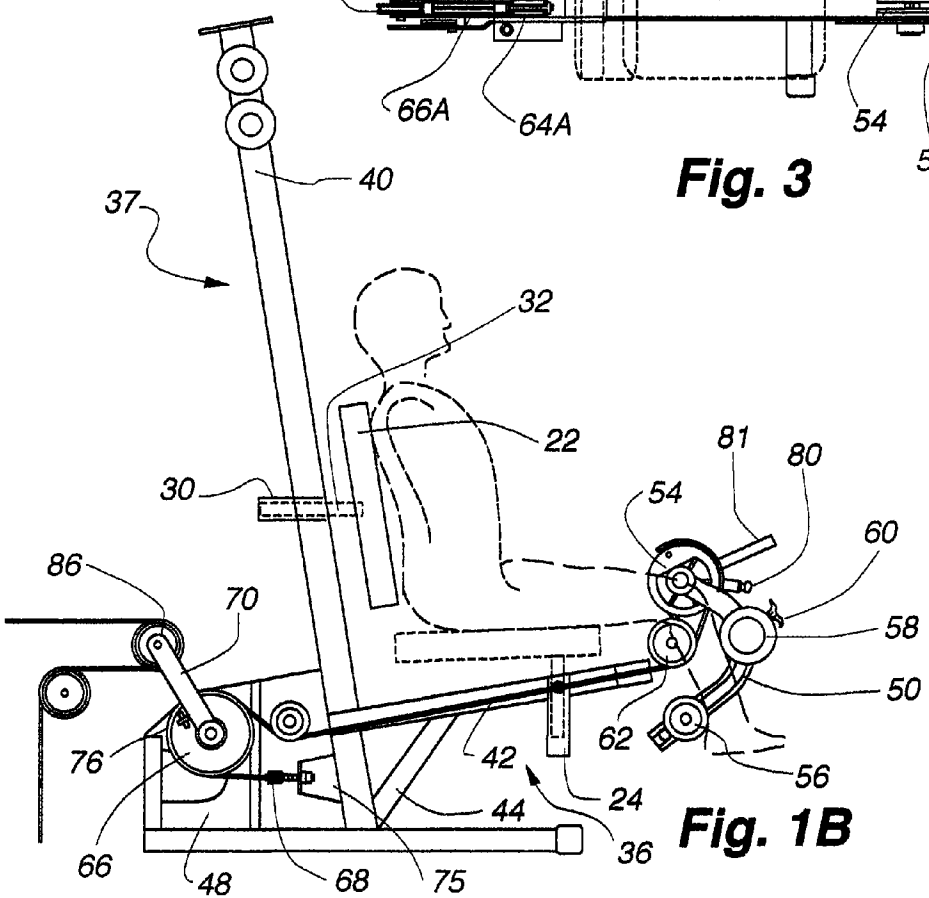
FIG. 1B is a side view of the seated leg curl/extension machine of the present invention situated in the end position for a leg curl exercise.
Figure 2:
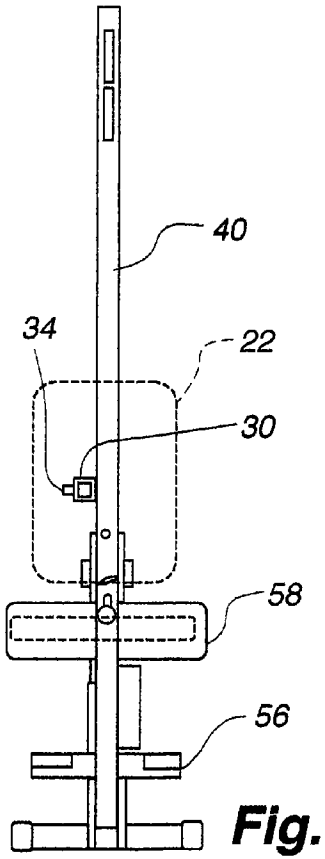
FIG. 2 is a partial rear view of the seated leg curl/extension machine of the present invention.

As best seen in FIG. 1B, at the front end of the seat frame 36 is a lever arm 50 engaged by a user to activate the dual pulley system of the present invention for performing exercises. The lever arm 50 curves downwardly from a pair of brackets 52 (see FIGS. 1A and 6) to which it is pivotally connected. The brackets 52 extend upwardly from the seat frame 36 to support the pivot structure, to which is attached a front pulley 54 and the curved lever arm 50. The brackets are affixed to the main seat frame member 42. The lever arm 50 and the front pulley 54 pivot together, as described in greater detail below. Roller pads 56, or bottom pads, extend outwardly from either side of the bottom end of the lever arm 50. These roller pads 56 are used for both leg curls and leg extension exercises. Leg hold-down pads 58, or upper pads, extend outwardly from either side of the middle of the lever arm 50. These pads 58 are used to engage the user's shins and firmly clamp the user's shins in place while performing a leg curl. The hold-down pads 58 are rotatably connected to the lever 50, and are lockable with a locking clamp mechanism 60. Preferably, a single axle runs through both pads 58 so that they rotate in unison, and are locked in unison. The pads 58 are eccentrically mounted on the axle in order that their rotation increases or decreases the gap between the hold-down pad 58 and the lower pad 56 at the user's discretion, in order to preferably firmly clamp the user's shin between the hold down pad 58 and the lower pad 56. This is described in more detail below.

The inventive pulley system is shown in FIG. 4, and includes from front to back (right to left on FIG. 4) a front main pulley 54 having two tracks or cable grooves, a pair of single front guide pulleys 62, a pair of single rear guide pulleys 64, a pair of single rear main pulleys 66 (each having a single track) and a tensioner pulley 68. In the embodiment shown in FIG. 4, the tensioner pulley is mounted to a tensioner bracket 75 on the frame 37. Alternatively, the tensioner pulley may be mounted to the rear housing 48 (see FIG. 6). A pulley arm 70 is pivotally attached at the pivot axis of the rear main pulleys 66, and is freely pivotable with respect to the rear main pulleys 66. Two main cables A & B and a tensioner cable T are also included in the pulley system.

Figure 5:
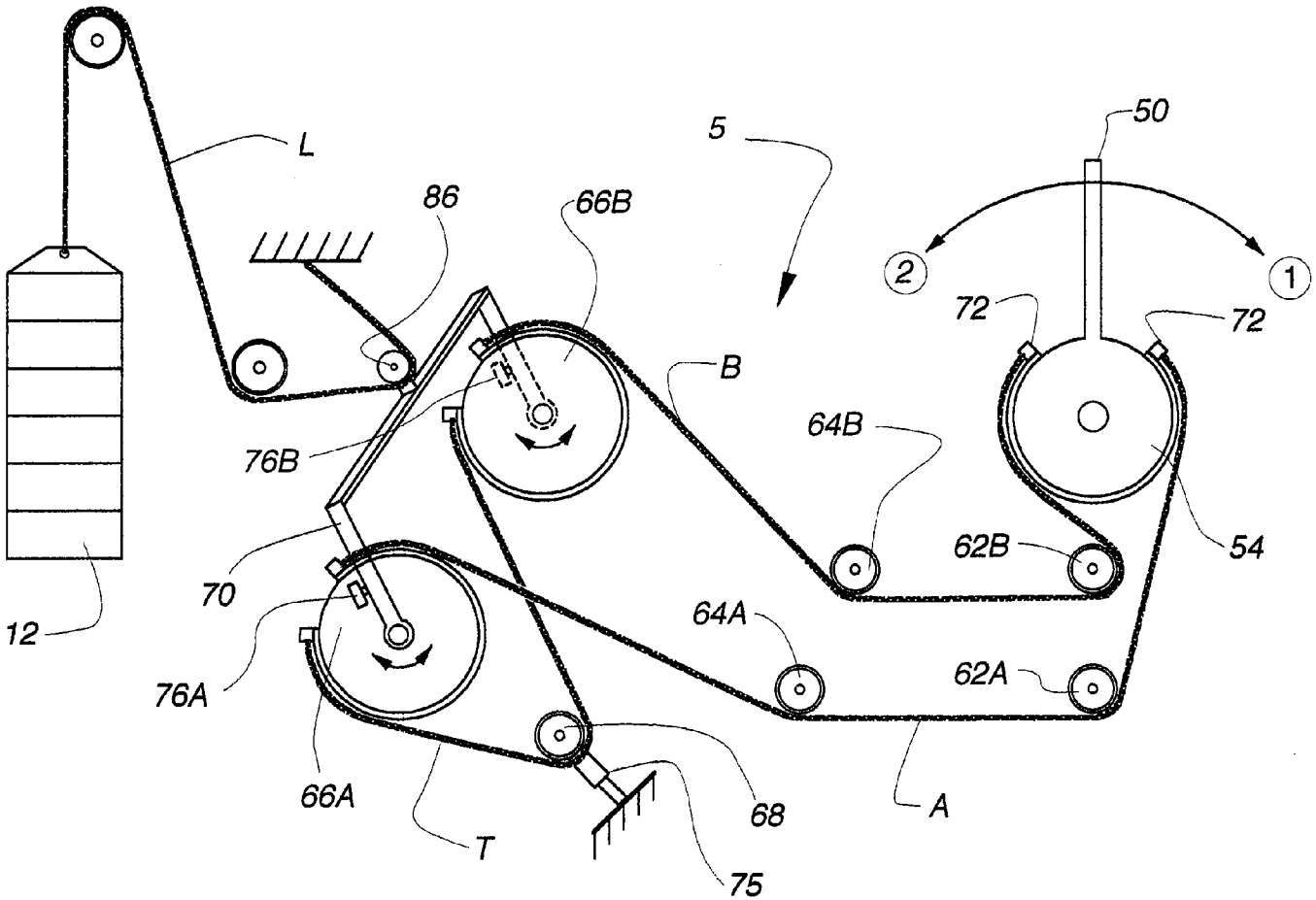
FIG. 5 is a schematic view of the dual-direction pulley system of the present invention.

FIG. 5 shows a schematic of the unique dual-direction pulley system 5 of the present invention, and represents one embodiment of the present invention. In the dual-direction pulley system of FIG. 5, the front main pulley 54 is pivotally supported by a frame (not shown in FIG. 5). There are two cable guides 72 formed at the perimeter of the front main pulley 54, one for primary cable A and the other for primary cable B. The front end of primary cable A is fixed to the front main pulley by a pin, a releasable cable stop, or the like, and extends at least partially around the front of the pulley. Cable A then runs over a front guide pulley 62A and a rear guide pulley 64A for proper positioning (the two guide pulleys are not necessary in certain configurations, and additional guide pulleys may be necessary in other configurations) and extends to a rear main pulley 66A, and is guided over at least a portion of the perimeter of the rear main pulley 66A. The rear main pulley 66A is pivotally supported by the frame (not shown in FIG. 5). The rear end of cable A is fixed to the rear main pulley 66A.

Similar to the routing of cable A, the front end of primary cable B is fixed to the front main pulley 54 by a pin, releasable cable stop, or the like, and extends at least partially around the rear of the pulley 54 (in this configuration, opposite the direction cable A is wrapped around the front main pulley). Cable B then runs over a front guide pulley 62B and a rear guide pulley 64B for proper positioning (the two guide pulleys are not necessary in certain configurations) and extends to a rear main pulley 66B, and is guided over at least a portion of the perimeter of the rear main pulley 66B. The rear main pulley 66B is pivotally supported by the frame 37 (not shown in FIG. 5). Rear main pulleys 66A and 66B are free to pivot independently from each other. The rear end of cable B is fixed to the rear main pulley 66B.

With further reference to FIG. 5, one end of the tensioner cable T is run over a portion of and attached to the perimeter of rear main pulley 66A and the other end is run over a portion of and attached to the perimeter of rear main pulley 66B. Between its ends, the tensioner cable T is routed through a tensioner pulley 68. Preferably, as shown in FIG. 5, the primary cables A, B are each connected over the top of the respective rear main pulleys 66A,B, and the ends of the tensioner cable T are each connected around the bottom of each respective rear main pulley 66A,B. As a result, the rotational motion of the main pulleys 54, 66A, and 66B is interconnected. Rotation of any one of the main pulleys 54, 66A, or 66B will cause a corresponding reactive rotation in the remaining two pulleys. This relationship is described in more detail below. More particularly, rotation of the front main pulley 54, as for example by applying a force to actuator 50, will cause a reactive rotation of the rear main pulleys 66A,B. The force applied to the actuator 50 is effectively transmitted through the cables A, B to the rear main pulleys 66A, B. Similarly, any resistance forces applied to the rear main pulleys 66A,B will be transmitted through the cables A, B to the front main pulley 54 and the actuator 50.

This system thus forms a closed-loop cable system, shown in FIG. 5, that creates reaction when the front main pulley 54 is rotated in either direction. For instance, when the front main pulley 54 is rotated clockwise to position 1, cable B is pulled in tension a certain distance X, and creates slack in cable A of that same length. This movement of cable B in turn causes rear main pulley 66B to rotate in a clockwise direction also the same amount X. The tensioner cable T then is also pulled in tension on rear main pulley 66B and runs through the tensioner pulley 68 and causes the rear main pulley 66A to rotate in a counterclockwise direction a distance X to take up the slack in cable A.

Similarly, when the front main pulley 54 is rotated counter-clockwise to position 2, cable A is pulled in tension a certain distance Y, and creates slack in cable B of that same length. This movement of cable A in turn causes rear main pulley 66A to rotate in a clockwise direction also the same amount Y. The tensioner cable T then is also pulled in tension on rear main pulley 66A and runs through the tensioner pulley 68 and causes the rear main pulley 66B to rotate in a counterclockwise direction a distance Y to take up the slack in cable B.

A catch 76 (such as a flange, pin, bent member, or other protrusion) extends from the side of each rear main pulley 66A and 66B to engage the pulley arm 70 when that particular rear main pulley is rotated clockwise (according to FIG. 5). As a catch 76 rotates clockwise with the rear main pulley 66 on which it is formed, it engages the pulley arm 70, which in turn actuates the load mechanism to create the resistance at the lever 50. For instance, when the lever 50 in FIG. 5 is rotated toward position 1, cable B is tensioned, and as described above, causes rear main pulley 66B to rotate in a clockwise direction. The catch 76B on rear main pulley 66B then engages the pulley arm 70, which in turn actuates the load 12. What also happens is that the tensioner cable T is pulled around rear main pulley 66B in the clockwise direction, causing rear main pulley 66A to rotate counter-clockwise, thus moving the catch 76A on rear main pulley 66A away from the pulley arm 70, and at the same time taking up the slack created in cable A by the movement of the lever 50 to position 1. The catch 76 can have an adjustable surface on it, such as a set screw, to fine-tune the engagement position between the flange 76 and the pulley arm 70.

When assimilated into a weight stack system, the lever arm 50 that moves the front main pulley 54 is the lever arm 50 to which the roller pads 56, 58 are attached (see FIG. 4). Also, the pulley arm 70 may be pivotally attached to the pivot axis of rear main pulleys 66A and 66B (or a pivot axis effectively concentric with the pivot axis upon which each of the rear main pulleys 66A and 66B are attached). It is not necessary that that pulley arm 70 pivot about the same axis as the rear main pulleys 66A and 66B. By sharing the same axis as the rear main pulleys 66A and 66B, the mechanical advantage of the catch 76 pressing against the pivot arm 70 remains constant. If a nonlinear load actuation was desired a different pivot point could be selected for the pulley arm 70. This would result in the catch 76 sliding along the pulley arm 70 as the pulley arm 70 and rear main pulley 66A rotate, resulting in a varying mechanical advantage for the catch 76.

It should also be noted that rather than a single pulley arm 70, separate pivot arms could be provided for each rear main pulley 66A and 66B. If desired, different loading reactions could be created for each pulley arm by choosing different pivot points.

It should also be understood that while the pulley system 5 has been described in terms of a front and rear orientation, there is no necessary limit on how the pulleys are arranged. For example, the front main pulley 54 could be called a first main pulley, the rear main pulley 66A could be called a second main pulley, and the rear main pulley 66B could be called a third main pulley. It is not necessary to locate the second and third main pulleys rearwardly from the first main pulley, nor even to make the second and third main pulleys coaxial. Certain efficiencies result from the preferred arrangement, but it is not a required arrangement.

In FIG. 4, the pulley arm 70 is H-shaped (see also FIG. 6), with the bottom two legs each attached to the pivot axis of the respective rear main pulley 66A,B. The top of the pulley arm 70 is operably connected to a load mechanism 78, such as a weight stack, as is known in the art. In the embodiment shown a loading cable L is fixed to the frame 37 at one end, and extends through a pulley arm pulley 86, and then routed through a series of pulleys to the weight stack 12. Other load mechanisms, such as resilient bands or rods, may also be used.

In this way, the lever 50 can be moved in either direction under load (caused by the catch 76 on each of the rear main pulleys 66A,B causing the pulley arm 70 to actuate the load mechanism 12), allowing opposite direction rotation (dual-directions) of the pulley 54 to be used easily and efficiently.

Figure 7:
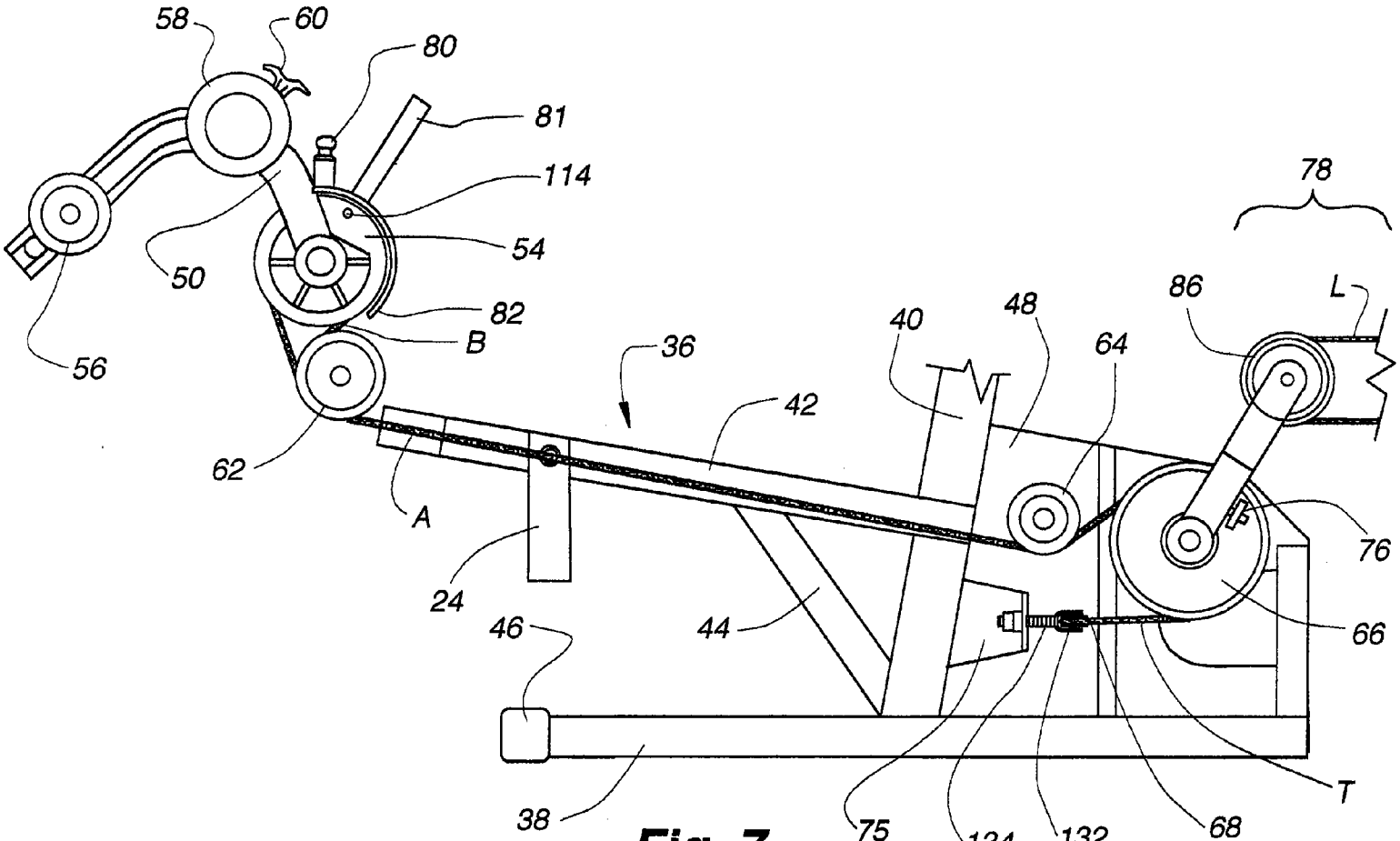
FIG. 7 is a side view of the seated leg curl/extension machine of the present invention in a rest position for a leg curl exercise.
Figure 8:
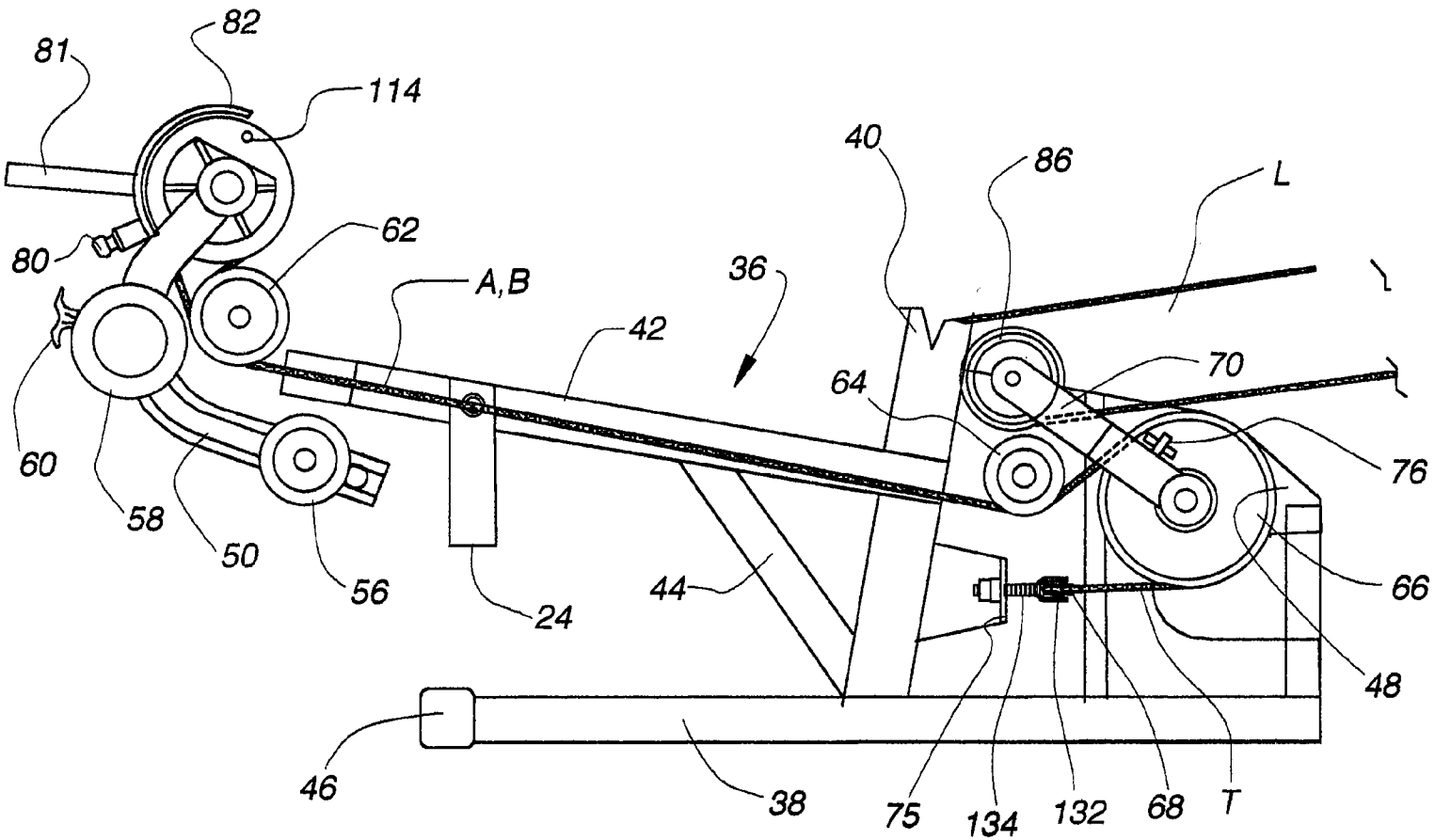
FIG. 8 is a side view of the seated leg curl/extension machine of the present invention in an end position for the leg curl exercise.
Figure 9:
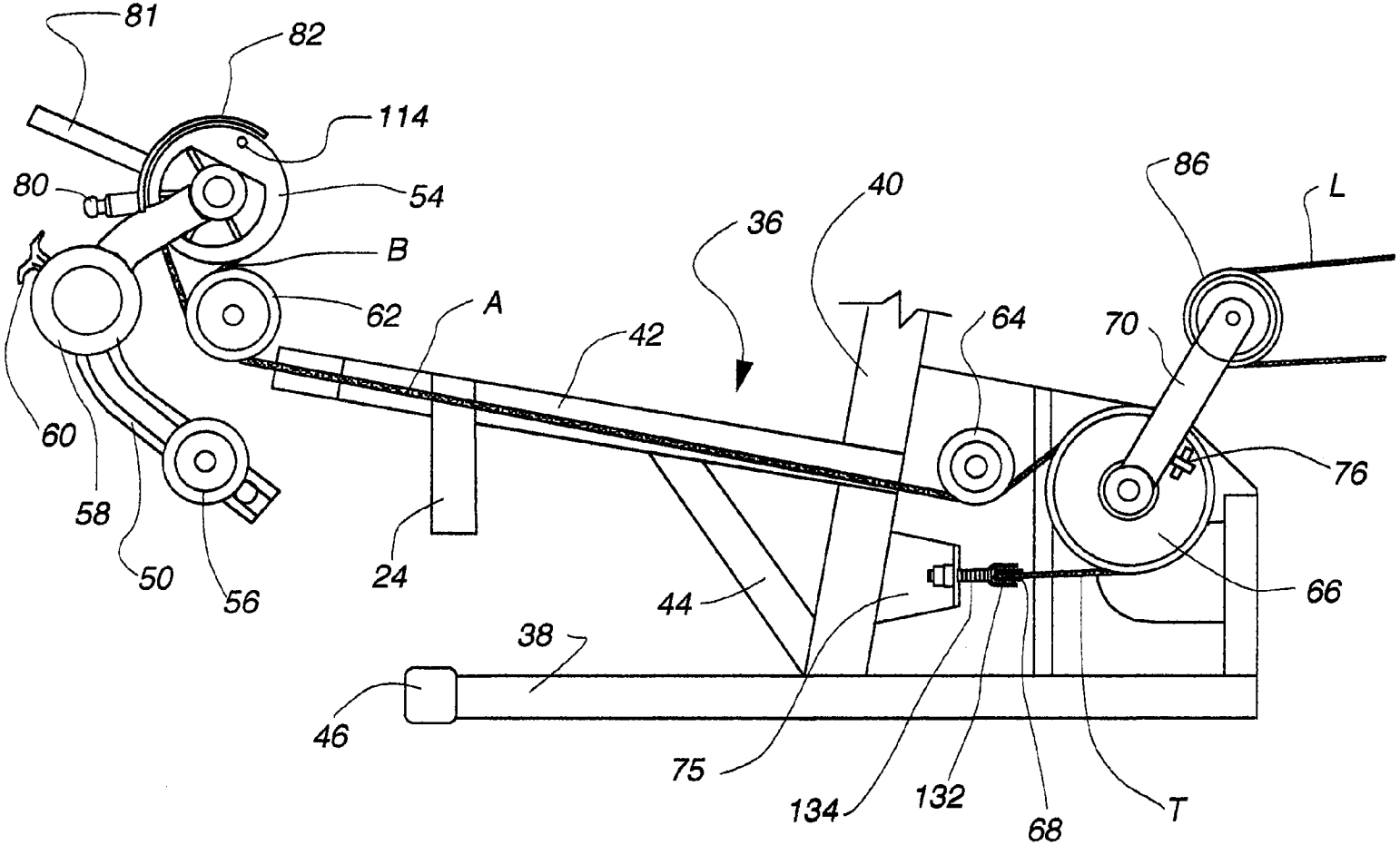
FIG. 9 is a side view of the seated leg curl/extension machine of the present invention in a rest position for a leg extension exercise.
Figure 10:
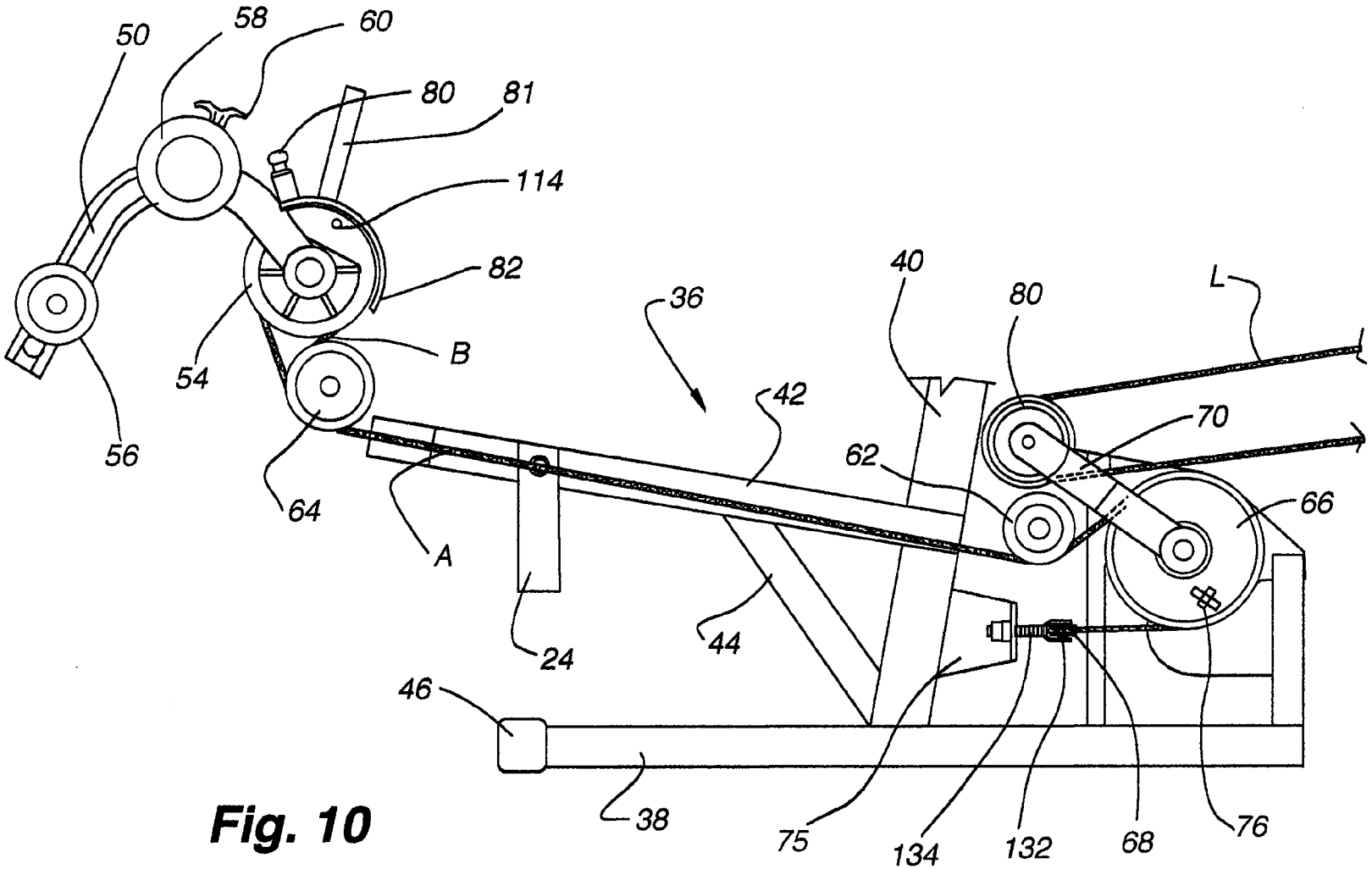
FIG. 10 is a side view of the seated leg curl/extension machine of the present invention in an extended position for the leg extension exercise.

In the implementation of this pulley system in a leg extension/curl machine, the collar 82 can be moved around the perimeter of the front main pulley 54 using the handle 81 to provide the proper positioning of the lever 50 to allow for either leg extensions or leg curls. For instance, with reference to FIGS. 7–10, in FIG. 7 the lever 50 is shown positioned to extend from approximately 11 o'clock from the front main pulley 54 to facilitate the leg curl exercise. In FIG. 9, the lever 50 is shown positioned at approximately 8 o'clock from the front main pulley 54 to facilitate the leg extension exercise. FIGS. 8 and 10 show the end position for the leg curl and the leg extension, respectively. Note how in each of FIGS. 8 and 10 the respective catches 76 on main pulleys 66A and 66B engage the pulley arm 70 to cause it to pivot and the load to be actuated.

The adjustment structure that allows the relative re-positioning of the lever 50 with the front main pulley 54 is a pop-pin mechanism 80. A collar 82 extends around a central portion of the rim of the front main pulley 54. Referring to FIG. 7, the lever 50 is attached to the collar 82, and the collar 82 has an opening in it through which the pop-pin 80 selectively extends. A handle 81 is provided on the collar 82 to assist the user in gripping and adjusting the collar 82, but is not required. The central portion of the outer rim of the front main pulley 54 has a series of apertures 84 formed therein for positioning the lever 50 for either leg curls or leg extensions. Preferably there are apertures 84 formed at varying angles to accommodate different exercises. Each aperture corresponds to a resting, or starting position, for the actuating lever 50 for an exercise, such as a leg curl or leg extension. For example in the preferred embodiment a first set of apertures is provided that correspond to a starting position for the leg curl exercise. These apertures are formed such that the lever 50 is maintained at approximately the 11 o'clock position shown in FIG. 7 to start the leg curl. More than one aperture is provided near this orientation to accommodate variances in anatomy and preference for starting position. Similarly, a second set of apertures is provided such that lever 50 is maintained at approximately the 8 o'clock position of FIG. 9 to start the leg extension exercise. As an example, FIG. 6 shows a aperture 84 in the central rim of the front main pulley 54 for use in positioning the lever 50 for the leg curl exercise.

As seen in FIGS. 4 and 7–10, the primary cables A, B run through the tubular seat frame member 42 in the preferred embodiment. In this fashion the cables A and B are hidden from view, and are protected. The cables A and B could be anywhere necessary to extend as needed to the rear main pulleys 66.

Figure 6:
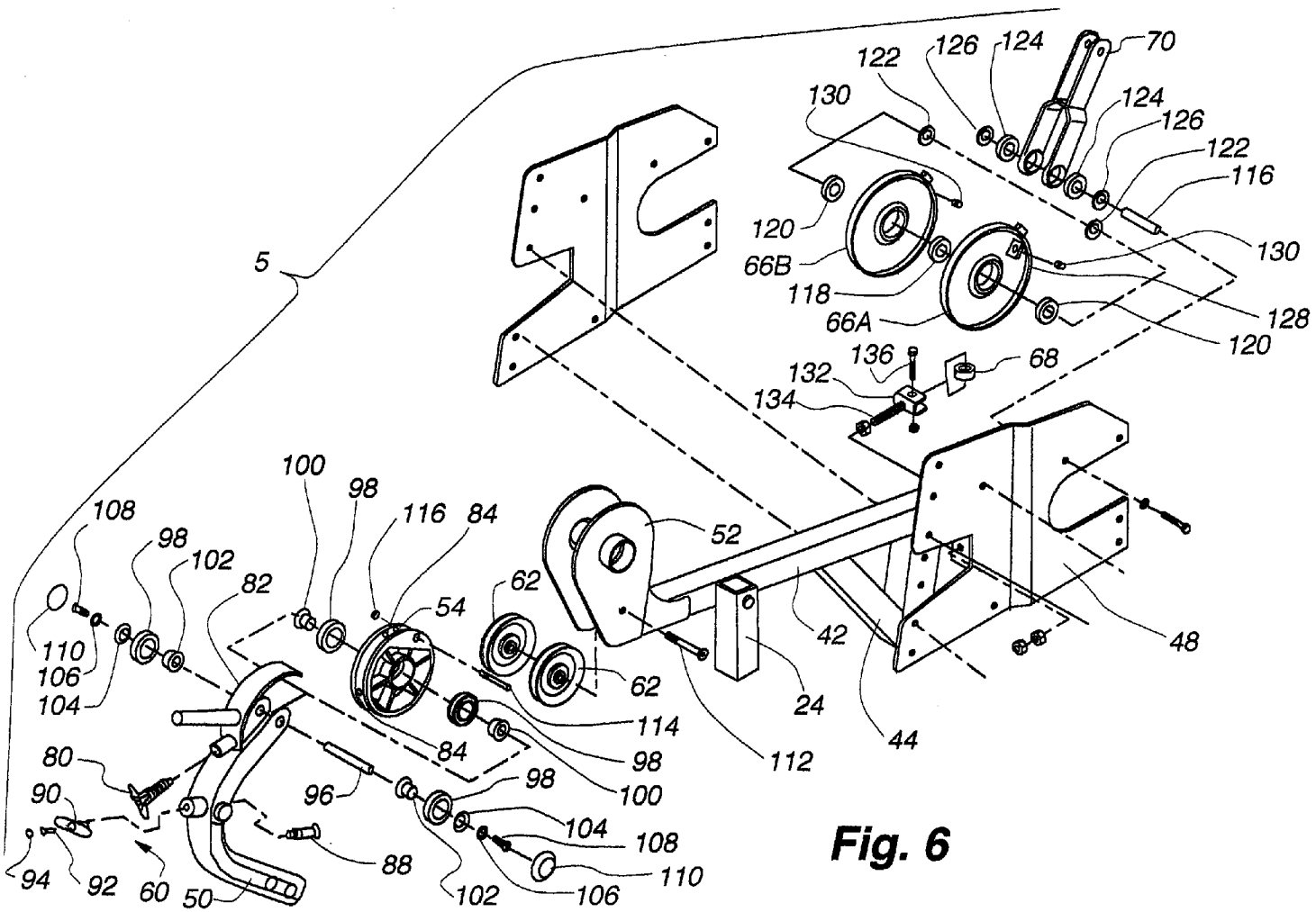
FIG. 6 is an exploded perspective view of the pulley system of the present invention.

FIG. 6 shows an exploded assembly view of a pulley system 5 according to the present invention. Working from front to rear (left to right in FIG. 6), the first part of the assembly is the leg hold down locking clamp mechanism 60, which includes a friction pad 88, an adjustment handle 90, a fastening screw 92, and a screw cover 94. The pop pin 80 is received through collar 82, which is pivotally mounted on pivot shaft 96, along with the lever arm 50 and the front main pulley 54. The pop pin 80 will engage apertures 84 formed in the central portion of the front main pulley 54. The pivot assembly mounted on bracket 52 includes bearings 98, bushings 100, step spacers 102, shim washers 104, lock washers 106, button head screws 108, and plastic finishing caps 110. The front guide pulleys 62 are also mounted on the bracket 52, generally beneath the front main pulley 54. The front guide pulleys 62 rotate freely, and independently on bolt 112. Cable lock pin 114 is used to fasten the main cables A & B to the front main pulley 54. Each of the cables A & B has a loop formed in their end. The front main pulley 54 has openings through which the loops at the end of the cables A & B extend, so that the cable lock pin 114 passes through the loops to retain the cables A & B in place on the front main pulley 54. C-clamps (or snap rings) 116 may be used to fasten the cable lock pin 114 in place.

The rear pivot assembly is pivotally connected to the rear housing 48. The rear main pulleys 66A,B are separated by a spacer 118, and are pivotally mounted on rear pivot shaft 116. Bearings 120 and spacers 122 are provided between the rear main pulleys 66A and 66B and the pulley arm 70. Another set of bearings 124 and spacers 126 are provided between the outward facing surfaces of the pulley arm 70 and the inward facing surfaces of the rear housing 48. The pulley arm 70, and rear main pulleys 66A,B are thereby freely rotatable on the rear pivot shaft 116. Catches 76 are mounted on the outward facing sides of the rear main pulleys 66A,B. In the embodiment shown, each catch 76 takes the form of a flange 128, which extends generally perpendicularly from the side of the pulley 66A,B, and a set screw 130. In this embodiment, it is the set screw 130 that actually contacts the pulley arm 70 when the rear main pulleys 66A,B rotate in the proper direction (counterclockwise as seen in FIG. 6).

The tensioner pulley 68 is mounted on a bracket 132 by a bolt 136. The tensioner pulley bracket 132 is mounted to the rear housing 48 via threaded bolt 134. The amount of tension in cable T can be adjusted by turning the threaded bolt 134 to shorten or lengthen the amount of offset from the rear housing 48.

Figure 11:
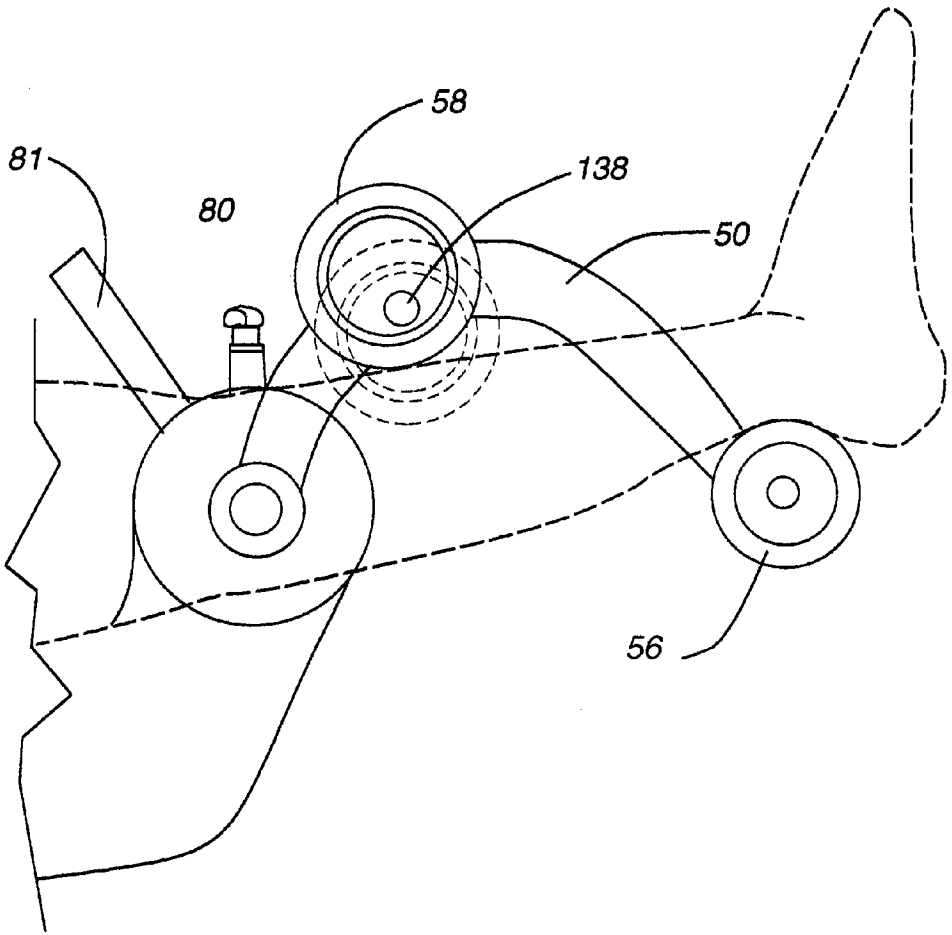
FIG. 11 is an enlarged side view illustrating how the leg hold-down pad functions.

As best seen in FIG. 11, each hold-down pad 58 extending off the lever 50 is rotationally mounted to the lever, as mentioned above. Each substantially cylindrical hold-down pad 58 is mounted eccentrically to its rotational axis so that when a person's leg is positioned between the lower pad 56 and the hold-down pad 58, the hold down pad can be rotated to snugly contact the person's shin (it is used only for the leg curls, and is not used for the leg extensions). FIG. 11 shows in phantom lines a users leg and the rotation of the hold-down pad 58 to accommodate the leg. Once a user's leg is in place, the position of the hold-down pad 58 is fixed to prevent it from rotating about the axle 138 by a locking clamp mechanism 60 including a friction pad 88 (or similar other similar mechanism such as a set screw) attached to the lever arm 50 (see elements 88, 90, and 92 in FIG. 6). The friction pad 88 engages the common axle 138 extending through both hold down pads 58 to fix their position. Alternatively, any other type of fixing mechanism could be used if the hold-down pads 58 were not on a common axle since the locking clamp mechanism 60 is mounted at a location between the inner ends of the hold-down pads 58 (at the lever arm 50). The hold-down pad 58 has a cushion that is rotationally fixed to the axle, whether it is a common axle for both sides, or an individual axle for both sides. This is to keep the pad 58 from rotating on the axle 138 during use, which would adversely affect its performance. There needs to be constant contact between the hold-down pad 58 and the user's leg in order for the leg curl exercise to feel right. In order to facilitate this it is preferred that the hold-down pad 58 be soft and have a somewhat tacky or slip-resistant outer texture. An outer cover could be used on the pad 58 which could rotate around the pad 58 in order to prevent excessive rubbing between the user's leg and the hold-down pad 58.

The front main pulley 54 could be a dual pulley that is structured so that each of the two pulleys are rotationally connected together to turn together. The rear mechanism could be positioned below the seat of the embodiment shown in FIG. 4 with the proper modifications. Cables mean any tension transmitting means, such as chain, rope, belts, etc. Pulleys could include sprockets or other mechanisms ways by which a cable is re-directed and creates some displacement by rotation or the like. The dual-direction pulley system could easily be adapted for use with other pairs of exercises that have matching movements in opposite directions, such as biceps curls and triceps extensions, or, lower back extensions and abdominal crunches.

Presently preferred embodiments of the present invention and many of its improvements have been described with a degree of particularity. The previous description is of preferred examples for implementing the invention, and the scope of the invention should not necessarily be limited by this description. The scope of the present invention is defined by the scope of the following claims.

The invention claimed is:

1. A dual-direction pulley system comprising:

a first main pulley having an actuator operably attached thereto;

a second main pulley;

a third main pulley;

a first cable wrapped at least part of the way around said first main pulley and fixed to said first main pulley and wrapped at least part of the way around said second main pulley and affixed thereto;

a second cable wrapped at least part of the way around said first main pulley opposite said first cable and fixed to said first main pulley and wrapped at least part of the way around said third main pulley and affixed thereto;

a tensioner cable, one end of which is wrapped at least partially around said second main pulley opposite of said first cable, and the other end of which is wrapped at least partially around said third main pulley opposite of said second cable; and a pulley arm reactive to the movement of either of said second and third main pulleys, said pulley arm attached to a load mechanism, wherein movement of said actuator causes movement of said pulley arm to engage said load mechanism.

2. The dual-direction pulley system according to claim 1, further comprising a tensioner pulley, said tensioner cable wrapped at least part of the way around said tensioner pulley.

3. The dual-direction pulley system according to claim 1, wherein said actuator is angularly adjustable relative to said first main pulley.

4. The dual-direction pulley system according to claim 3, wherein said actuator includes a retractable pin, wherein said first main pulley includes a plurality of openings for receiving said retractable pin, and wherein an angular orientation of said actuator relative to said first main pulley is dependent upon which opening said retractable pin is in engagement with.

5. The dual-direction pulley system according to claim 1, further comprising a first catch fixed on said second main pulley and a second catch fixed on said third main pulley, said first catch engaging said pulley arm upon movement of said actuator in a first direction; said second catch engaging said pulley arm upon movement of said actuator in a second direction opposite to said first direction.

6. The dual-direction pulley system according to claim 5, wherein said pulley arm is pivotal about a common axis with said second and third main pulleys.

7. The dual-direction pulley system according to claim 1, wherein said loading mechanism comprises a loading pulley and a loading cable, and wherein said loading cable has a first end that is fixed and a second end that is connected to a load, and wherein said loading cable wraps at least part of the way around said loading pulley.

8. The dual-direction pulley system according to claim 1, further comprising a frame on which said first, second, and third main pulleys are mounted, said frame having a hollow member; said first and second cables being enclosed along at least part of their length within said hollow member.

9. The dual-direction pulley system according to claim 1, further comprising a frame and a seat supported by said frame, and wherein said actuator comprises a lever, said seat being placed on said frame such that a user seated in said seat can perform leg extension exercises by rotating said lever in a first direction and leg curl exercises by rotating said lever in a second direction opposite to said first direction.

10. The dual-direction pulley system according to claim 9, wherein said actuator further comprises a first pad and a second pad, and wherein said second pad is mounted to said lever such that it is adapted to hold a leg of a user in place between said first pad and said second pad during leg curl exercises.

11. The dual-direction pulley system according to claim 10, wherein said second pad is eccentrically rotatably mounted to said lever.

12. An exercise apparatus for providing resistance to movement in opposite directions comprising:

a frame;

an actuating lever pivotally mounted to said frame, said actuating lever being pivotal in a clockwise direction and a counterclockwise direction;

a pulley system for providing resistance to rotation of said actuating lever when said actuating lever is moved in said clockwise direction and said counterclockwise direction;

said pulley system includes a first main pulley, a second main pulley, and a third main pulley;

said actuating lever is attached to said first main pulley such that rotation of said actuating lever causes rotation of said first main pulley;

a first cable connects said first main pulley with said second main pulley;

a second cable connects said first main pulley with said third main pulley; and a tensioning cable connects said second and third main pulleys such that rotation of said first main pulley causes corresponding rotation of said second and third main pulleys substantially without creating slack in said first and second cables.

13. The exercise apparatus according to claim 12, wherein said first and second main pulleys are operatively associated with a load such that when said first main pulley is rotated in a clockwise direction, rotation of said second main pulley is resisted by said load, and when said first main pulley is rotated in a counterclockwise direction, rotation of said third main pulley is resisted by said load.

14. The exercise apparatus according to claim 13, wherein said pulley system further comprises a pulley arm operatively associated with said load; wherein said second main pulley includes a catch that engages said pulley arm when said first main pulley is rotates in said clockwise direction; and wherein said third main pulley includes a catch that engages said pulley arm when said first main pulley rotates in said counterclockwise direction.

15. The exercise apparatus according to claim 12, wherein an angular orientation between said actuating lever and said first main pulley may be selectively adjusted to create multiple rest positions for said actuating lever.

16. The exercise apparatus according to claim 12, wherein said pulley system further comprises:

said first cable wrapped at least part of the way around said first main pulley and fixed to said first main pulley and wrapped at least part of the way around said second main pulley and affixed thereto;

said second cable wrapped at least part of the way around said first main pulley opposite said first cable and fixed to said first main pulley and wrapped at least part of the way around said third main pulley and affixed thereto;

said tensioning cable including one end of which is wrapped at least partially around said second main pulley opposite of said first cable, and the other end of which is wrapped at least partially around said third main pulley opposite of said second cable; and a pulley arm reactive to the movement of either of said second and third main pulleys, said pulley arm attached to a load mechanism, wherein movement of said actuating lever causes movement of said pulley arm to engage said load mechanism.

17. The exercise apparatus according to claim 12, further comprising a seat mounted to said frame, said seat being placed on said frame such that a user seated in said seat can perform leg extension exercises by rotating said actuating lever in a first direction and leg curl exercises by rotating said actuating lever in a second direction opposite to said first direction.

18. The exercise apparatus according to claim 17, wherein said actuating lever further comprises a first pad proximate to a free end of said actuating lever and a second pad mounted on said actuating lever between said first pad and a pivotally connected end of said actuating lever, and wherein said second pad is eccentrically rotatably mounted to said actuating lever such that it is adapted to hold a leg of a user in place between said first pad and said second pad during leg curl exercises.

19. An exercise apparatus for performing seated leg curls and seated leg extensions, the apparatus comprising:

a frame;

a pulley system mounted to said frame, said pulley system including a first main pulley, a second main pulley, and a third main pulley;

a first cable wrapped at least part of the way around said first main pulley and fixed to said first main pulley and wrapped at least part of the way around said second main pulley and affixed thereto;

a second cable wrapped at least part of the way around said first main pulley opposite said first cable and fixed to said first main pulley and wrapped at least part of the way around said third main pulley and affixed thereto;

a tensioner cable, one end of which is wrapped at least partially around said second main pulley opposite of said first cable, and the other end of which is wrapped at least partially around said third main pulley opposite of said second cable such that rotation of said first main pulley causes corresponding rotation in said second and third main pulleys;

a pulley arm reactive to the rotation of either of said second and third main pulleys, said pulley arm attached to a load mechanism;

an actuator lever attached to said first main pulley such that movement of said actuator lever causes rotation of said first main pulley, which causes corresponding rotation in said second and third main pulleys, which rotation of said second and third main pulleys causes said pulley arm to engage said load mechanism, said actuator lever being selectively adjustable in its angular orientation relative to said first main pulley; and a seat mounted on said frame such that a user seated in said seat can perform leg extension exercises by rotating said actuating lever in a first direction and leg curl exercises by rotating said actuating lever in a second direction opposite to said first direction; and a first pad and a second pad mounted on said actuating lever, said second pad eccentrically rotatably mounted to said lever such that it is adapted to hold a leg of a user in place between said first pad and said second pad during leg curl exercises and such that it is adjustable to accommodate different sized legs.

* * * * *